US010160091B2

(12) United States Patent
Hou et al.

(10) Patent No.: US 10,160,091 B2
(45) Date of Patent: Dec. 25, 2018

(54) CMP POLISHING HEAD DESIGN FOR IMPROVING REMOVAL RATE UNIFORMITY

(71) Applicant: Taiwan Semiconductor Manufacturing Company, Ltd., Hsin-Chu (TW)

(72) Inventors: Te-Chien Hou, Hsin-Chu (TW); Ching-Hong Jiang, Hsin-Chu (TW); Kuo-Yin Lin, Jhubei (TW); Ming-Shiuan She, Hsin-Chu (TW); Shen-Nan Lee, Jhudong Township (TW); Teng-Chun Tsai, Hsin-Chu (TW); Yung-Cheng Lu, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 4 days.

(21) Appl. No.: 14/942,582

(22) Filed: Nov. 16, 2015

(65) Prior Publication Data

US 2017/0136602 A1 May 18, 2017

(51) Int. Cl.
*B24B 37/20* (2012.01)
*B24B 37/32* (2012.01)

(52) U.S. Cl.
CPC ..... *B24B 37/20* (2013.01); *B24B 37/32* (2013.01)

(58) Field of Classification Search
CPC ..... B24B 37/20; B24B 37/32
See application file for complete search history.

(56) References Cited

U.S. PATENT DOCUMENTS

| | | | | |
|---|---|---|---|---|
| 5,762,539 | A * | 6/1998 | Nakashiba | B24B 49/16 451/285 |
| 5,964,653 | A * | 10/1999 | Perlov | B24B 37/30 451/285 |
| 6,113,468 | A * | 9/2000 | Natalicio | B24B 37/30 451/41 |
| 6,334,810 | B1 * | 1/2002 | Song | B24B 53/017 451/60 |
| 6,390,905 | B1 * | 5/2002 | Korovin | B24B 37/30 451/286 |
| 6,764,387 | B1 * | 7/2004 | Chen | B24B 37/30 451/286 |
| RE39,471 | E * | 1/2007 | Nakashiba | B24B 37/042 451/285 |
| 8,721,391 | B2 * | 5/2014 | Chen | B24B 37/32 451/285 |
| 2006/0154580 | A1 * | 7/2006 | Chen | B24B 37/30 451/288 |
| 2008/0119119 | A1 * | 5/2008 | Zuniga | B24B 37/32 451/287 |
| 2013/0102152 | A1 * | 4/2013 | Chao | B24B 37/32 438/692 |

* cited by examiner

*Primary Examiner* — Dung Van Nguyen
(74) *Attorney, Agent, or Firm* — Slater Matsil, LLP

(57) ABSTRACT

An apparatus for performing chemical mechanical polish on a wafer includes a polishing head that includes a retaining ring. The polishing head is configured to hold the wafer in the retaining ring. The retaining ring includes a first ring having a first hardness, and a second ring encircled by the first ring, wherein the second ring has a second hardness smaller than the first hardness.

20 Claims, 16 Drawing Sheets

CMP POLISHING HEAD DESIGN FOR IMPROVING REMOVAL RATE UNIFORMITY

BACKGROUND

Chemical Mechanical Polishing (CMP) is a common practice in the formation of integrated circuits. Typically, CMP is used for the planarization of semiconductor wafers. CMP takes advantage of the synergetic effect of both physical and chemical forces for the polishing of wafers. It is performed by applying a load force to the back of a wafer while the wafer rests on a polishing pad. A polishing pad is placed against the wafer. Both the polishing pad and the wafer are then counter-rotated while a slurry containing both abrasives and reactive chemicals is passed therebetween. CMP is an effective way to achieve global planarization of wafers.

A truly uniform polishing, however, is difficult to achieve due to various factors. For example, slurries are dispensed either from the top or bottom of the polishing pad. This will result in non-uniformity in polish rate for different locations of the wafer. If slurries are dispensed from the top, the edges of the wafers typically have higher CMP rates than the centers. Conversely, if slurries are dispensed from the bottom, the centers of the wafers typically have higher CMP rates than the edges. Furthermore, the non-uniformity may also be introduced from the non-uniformity in the pressure applied to different locations of the wafer. To reduce the non-uniformity in polishing rate, pressures applied on different locations of the wafers are adjusted. If the CMP rate in one region of a wafer is low, a higher pressure is applied to this location to compensate the low removal rate.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
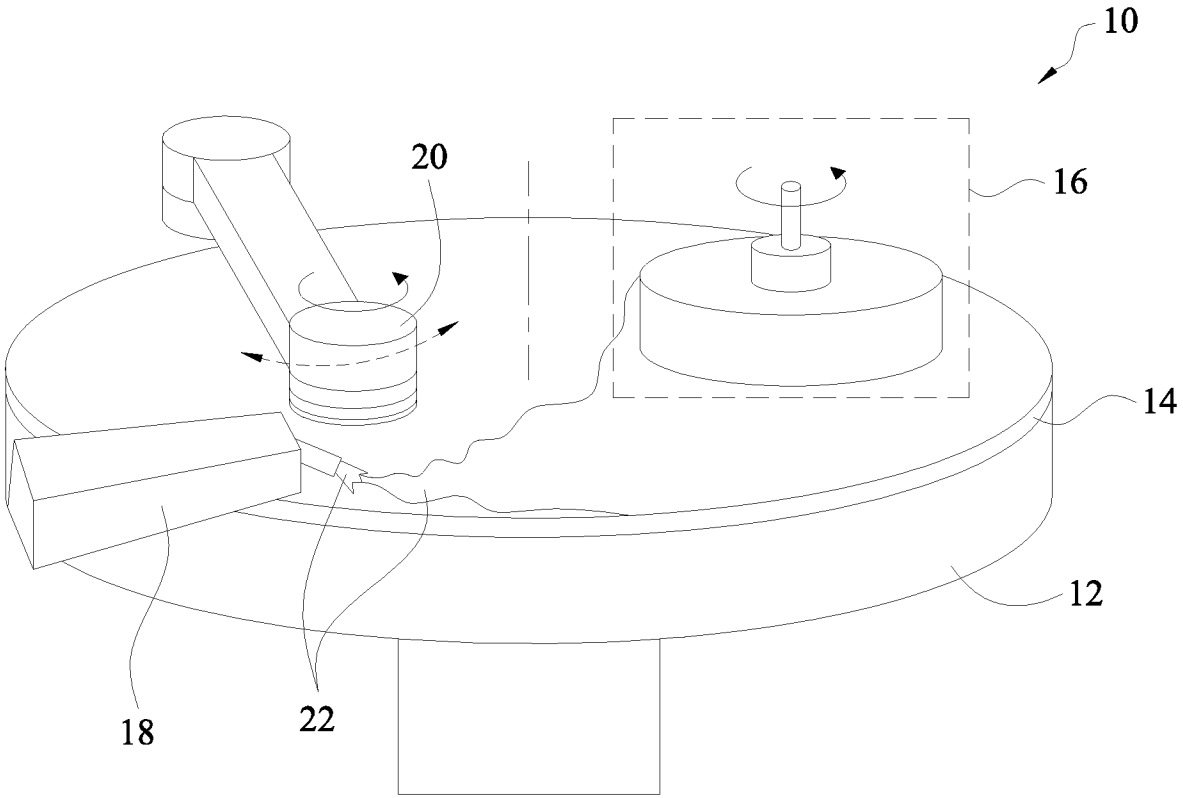
FIG. 1 illustrates an apparatus for performing Chemical Mechanical Polishing (CMP) in accordance with some embodiments.

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "underlying," "below," "lower," "overlying," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

A Chemical Mechanical Polishing (CMP) apparatus is provided in accordance with various exemplary embodiments. The variations of some embodiments are discussed. Throughout the various views and illustrative embodiments, like reference numbers are used to designate like elements. The embodiments of the present disclosure also include the scope of using the CMP apparatus in accordance with the embodiments to manufacture integrated circuits. For Example, the CMP apparatus is used to planarize wafers, in which integrated circuits are formed.

FIG. 1 schematically illustrates a perspective view of a part of a CMP apparatus/system in accordance with some embodiments of the present disclosure. CMP system 10 includes polishing platen 12, polishing pad 14 over polishing platen 12, and polishing head 16 over polishing pad 14. Slurry dispenser 18 has an outlet directly over polishing pad 14 in order to dispense slurry onto polishing pad 14. Disk 20 is also placed on the top surface of polishing pad 14.

Figure 5:
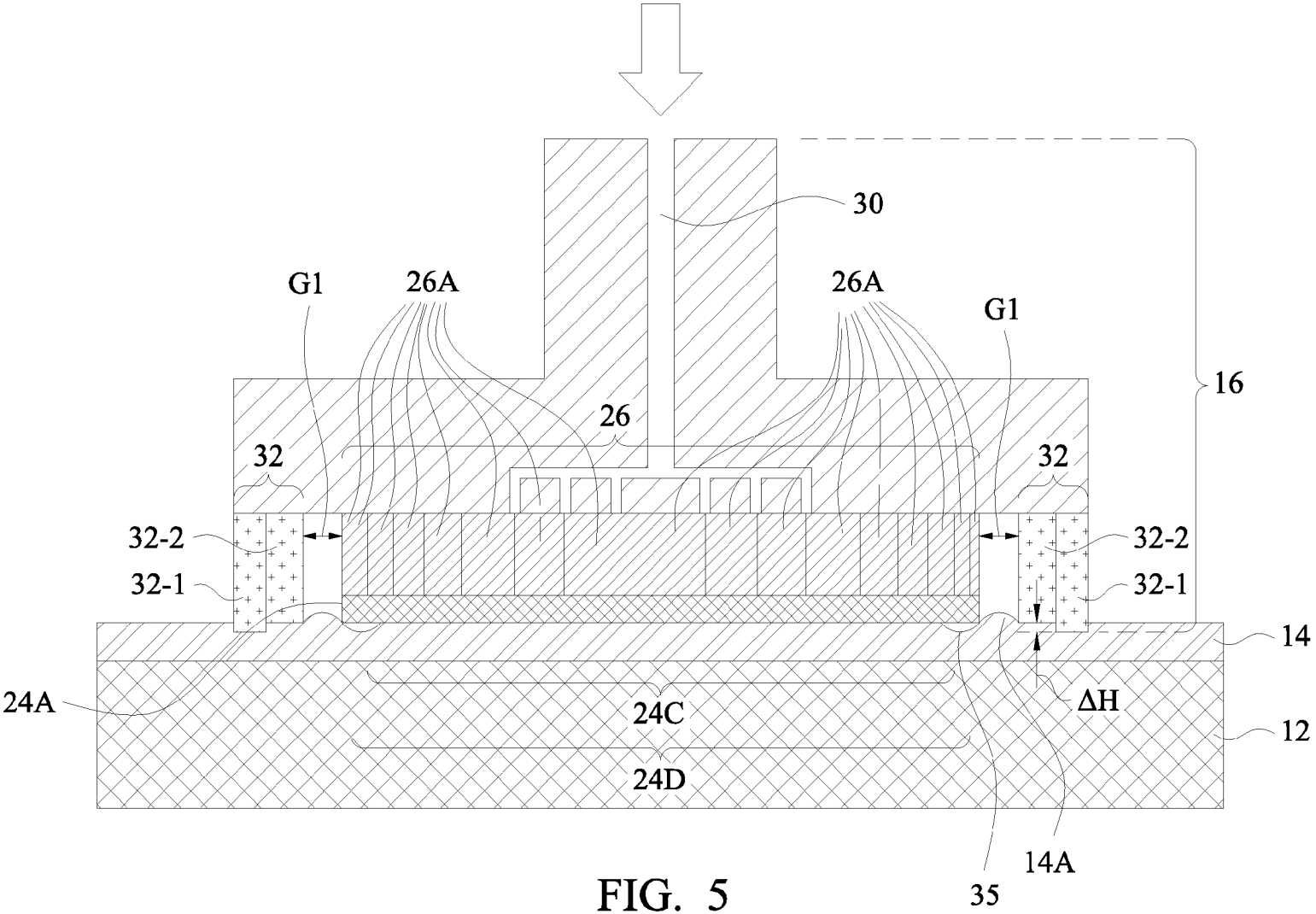

During the CMP, slurry 22 is dispensed by slurry dispenser 18 onto polishing pad 14. Slurry 22 includes a reactive chemical(s) that react with the surface layer of the wafer 24 (FIG. 5). Furthermore, slurry 22 includes abrasive particles for mechanically polishing the wafer.

Polishing pad 14 is formed of a material that is hard enough to allow the abrasive particles in the slurry to mechanically polish the wafer, which is under polishing head 16. On the other hand, polishing pad 14 is also soft enough so that it does not substantially scratch the wafer. During the CMP process, polishing platen 12 is rotated by a mechanism (not shown), and hence polishing pad 14 fixed thereon is also rotated along with polishing platen 12. The mechanism (such as a motor) for rotating polishing pad 14 is not illustrated.

On the other hand, during the CMP process, polishing head 16 is also rotated, and hence causing the rotation of wafer 24 (FIG. 2) fixed onto polishing head 16. In accordance with some embodiments of the present disclosure, as shown in FIG. 1, polishing head 16 and polishing pad 14 rotate in the same direction (clockwise or counter-clockwise). In accordance with alternative embodiments, polishing head 16 and polishing pad 14 rotate in opposite directions. The mechanism for rotating polishing head 16 is not illustrated. With the rotation of polishing pad 14 and polishing head 16, slurry 22 flows between wafer 24 and polishing pad 14. Through the chemical reaction between the reactive chemical in the slurry and the surface layer of wafer 24, and further through the mechanical polishing, the surface layer of wafer 24 is removed.

FIG. 1 also illustrates disk 20 over polishing pad 14. Disk 20 is configured to remove undesirable by-products generated during the CMP process. In accordance with some embodiments of the present disclosure, disk 20 contacts the top surface of polishing pad 14 when polishing pad 14 is to be conditioned. During the conditioning, both polishing pad 14 and disk 20 rotate, so that the protrusions or cutting edges of disk 20 move relatively to the surface of polishing pad 14, and hence polishing and re-texturizing the surface of the polishing pad 14.

Figure 2:
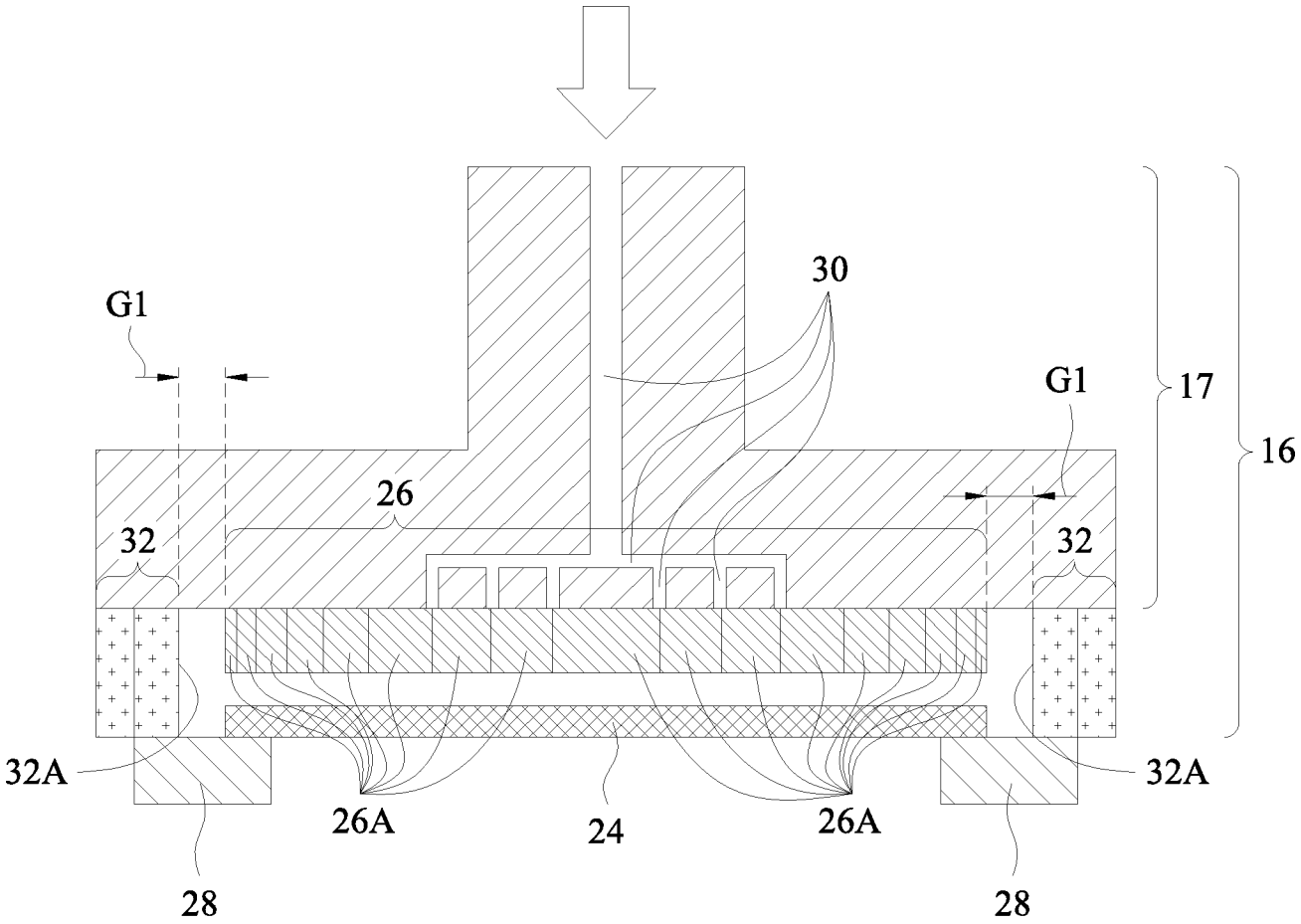
FIGS. 2 through 5 illustrate the cross-sectional views of intermediate stages of a CMP process in accordance with some embodiments.
Figure 3:
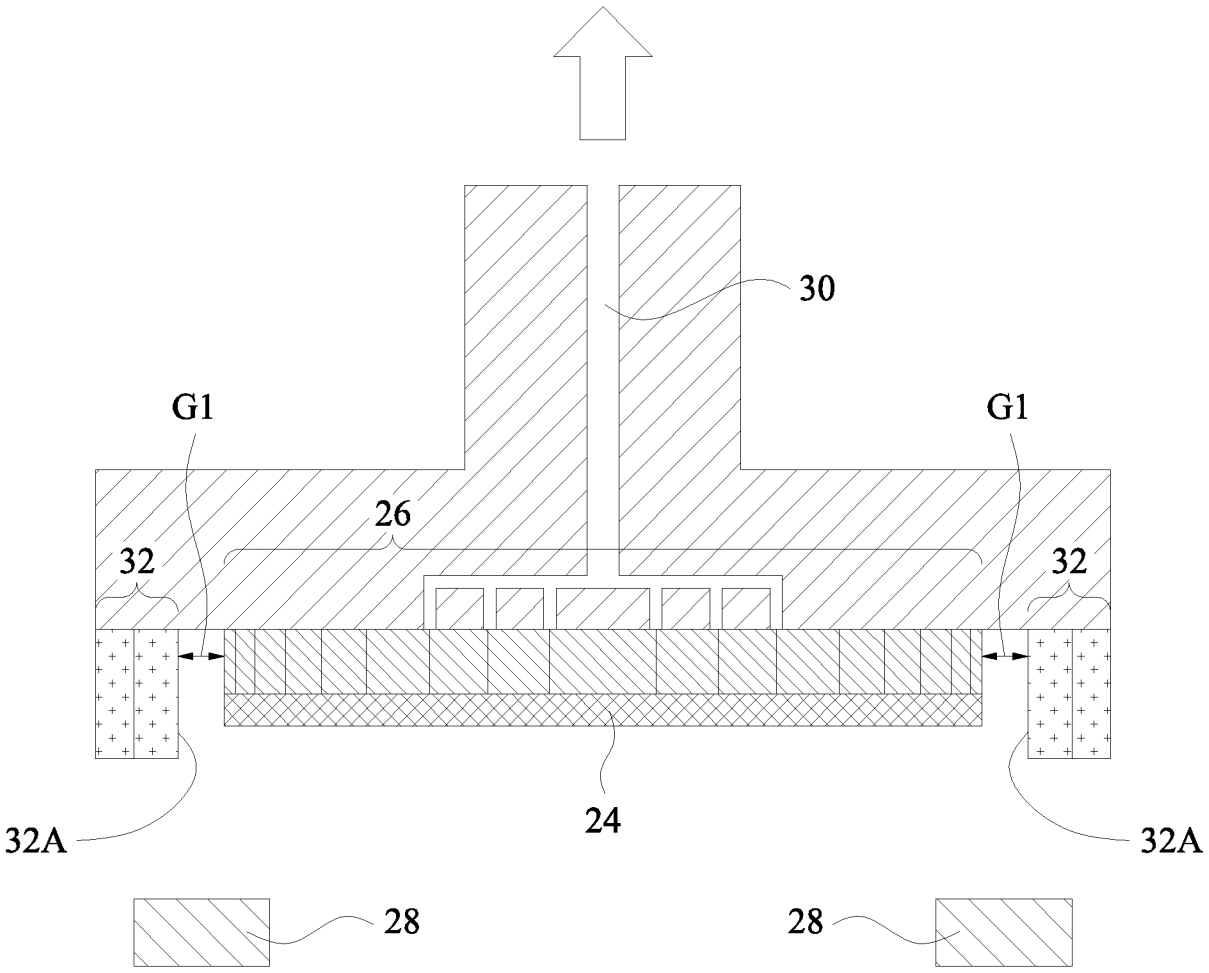

FIGS. 2 through 5 illustrate cross-sectional views of intermediate stages in an exemplary CMP process. Referring to FIG. 2, polishing head 16 is provided. Polishing head 16 includes wafer carrier assembly 17, which is configured to hold and fix wafer 24 in various process steps. Wafer carrier assembly 17 includes air passages 30, in which vacuum may be generated. By vacuuming air passages 30, wafer 24 is sucked up for the transportation of wafer 24 to and away from polishing pad 14 (FIG. 1).

As shown in FIG. 2, polishing head 16 is moved over wafer 24, which is placed over wafer stage 28. Next, referring to FIG. 3, vacuum is generated in air passages 30, and wafer 24 is picked up. Although not shown in FIG. 3, air passages 30 also include some portions in flexible membrane 26, and hence when wafer 24 is picked up, the bottom surface of flexible membrane 26 contacts the top surface of wafer 24. The picked-up wafer 24 is located in the space defined by retaining ring 32, which forms a circular ring. When picking up wafer 24, the central axis of polishing head 16 is aligned to the center of wafer 24, so that the edges of wafer 24 may be equally spaced from the respective inner edges 32A of retaining ring 32 by gaps G1, which may be a substantially uniform gap around wafer 24.

Figure 4:
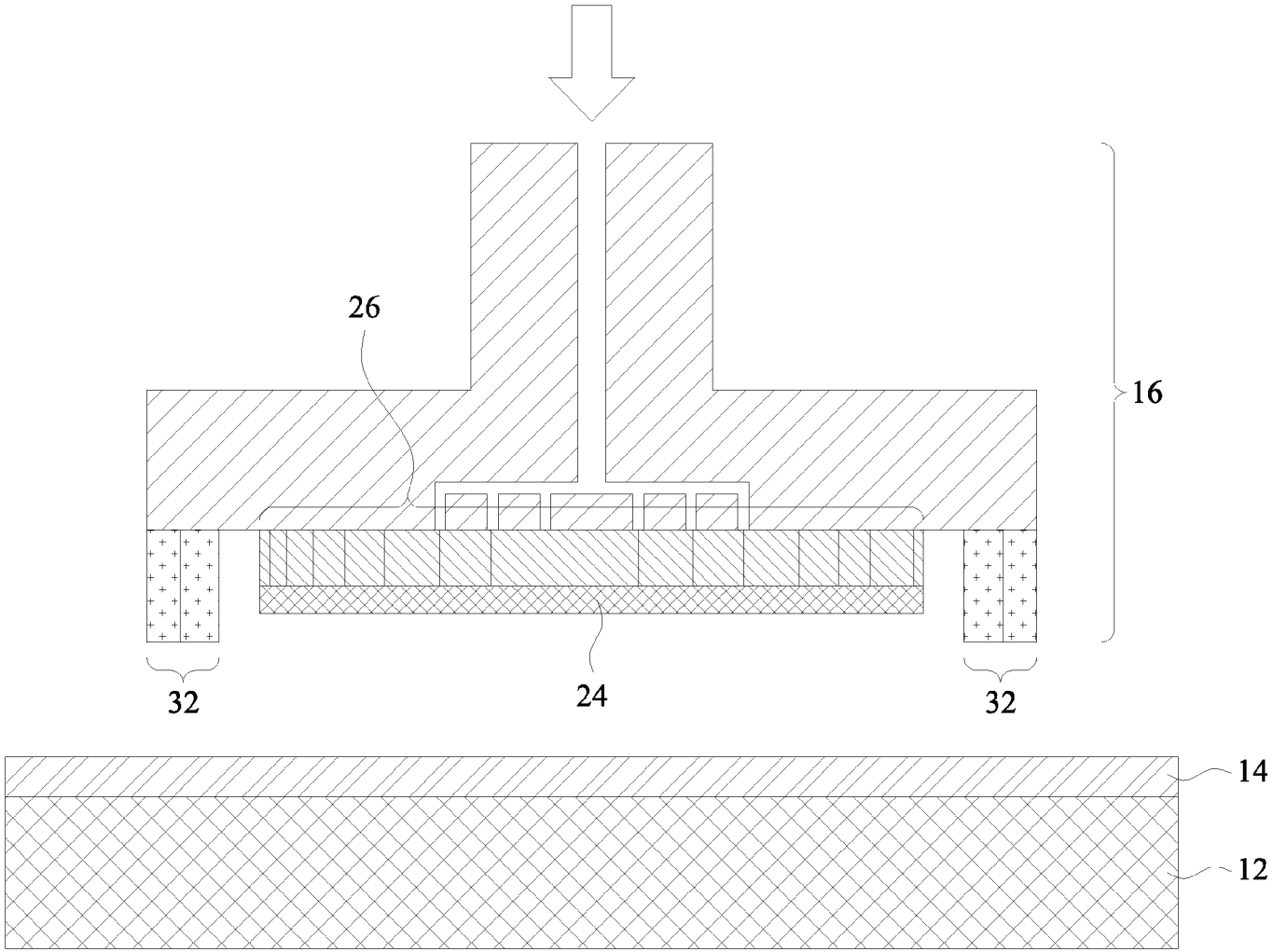

Referring to FIG. 4, polishing head 16 is moved over polishing pad 14, which is further located on platen 12. In accordance with some embodiments of the present disclosure, the illustrated portion of polishing pad 14 is not the center portion of polishing pad 14. Rather, as illustrated in FIG. 1, the illustrated portion is offset from the central axis of polishing pad 14. For example, the central axis of polishing pad 14, along with polishing pad 14 rotates, may be on the left side or right side of the illustrated portion.

Next, referring to FIG. 5, polishing head 16 is placed on, and also pressed against, polishing pad 14. The vacuuming in air passages 30 is then turned off, and hence wafer 24 is no longer sucked up. Flexible membrane 26 is inflated, for example, by pumping air into the plurality of zones 26A in flexible membrane 26. In accordance with some embodiments of the present disclosure, flexible membrane 26 is formed of a flexible and elastic material, which is formed of ethylene propylene rubber, neoprene rubber, nitrile rubber, or the like. The inflated flexible membrane 26 thus presses wafer 24 against polishing pad 14.

Membrane 26 includes a plurality of zones 26A. Each of zones 26A includes a chamber sealed by the flexible and elastic material. In a top view of flexible membrane 26, zones 26A have circular shapes, which may be concentric. Each of zones 26A is separated from other zones, and hence each of zones 26A may be inflated to have a pressure different from or equal to the pressures in other zones. Accordingly, the pressure applied by individual zones may be adjusted to improve the removal rate uniformity of the CMP. For example, by increasing the pressure of a zone, the polishing rate of the wafer portion directly under the zone may be increased, and vice versa.

When polishing head 16 is pressed against polishing pad 14, the bottom surface of retaining ring 32 is in physical contact with, and is pressed against, polishing pad 14. While not shown, the bottom surface of retaining ring 32 has some grooves, which allow slurry to get in and out of retaining ring 32 during the rotation of polishing head 16 (and retaining ring 32).

With wafer 24 being pressed against polishing pad 14, polishing pad 14 and polishing head 16 rotate, resulting in the rotation of wafer 24 on polishing pad 14, and hence the CMP is conducted. During the CMP, retaining ring 32 functions to retain wafer 24 in case wafer 24 is offset from the central axis of polishing head 16, so that wafer 24 is not spun off from polishing pad 14. In normal operation, however, retaining ring 32 may not be in contact with wafer 24.

Figure 6:
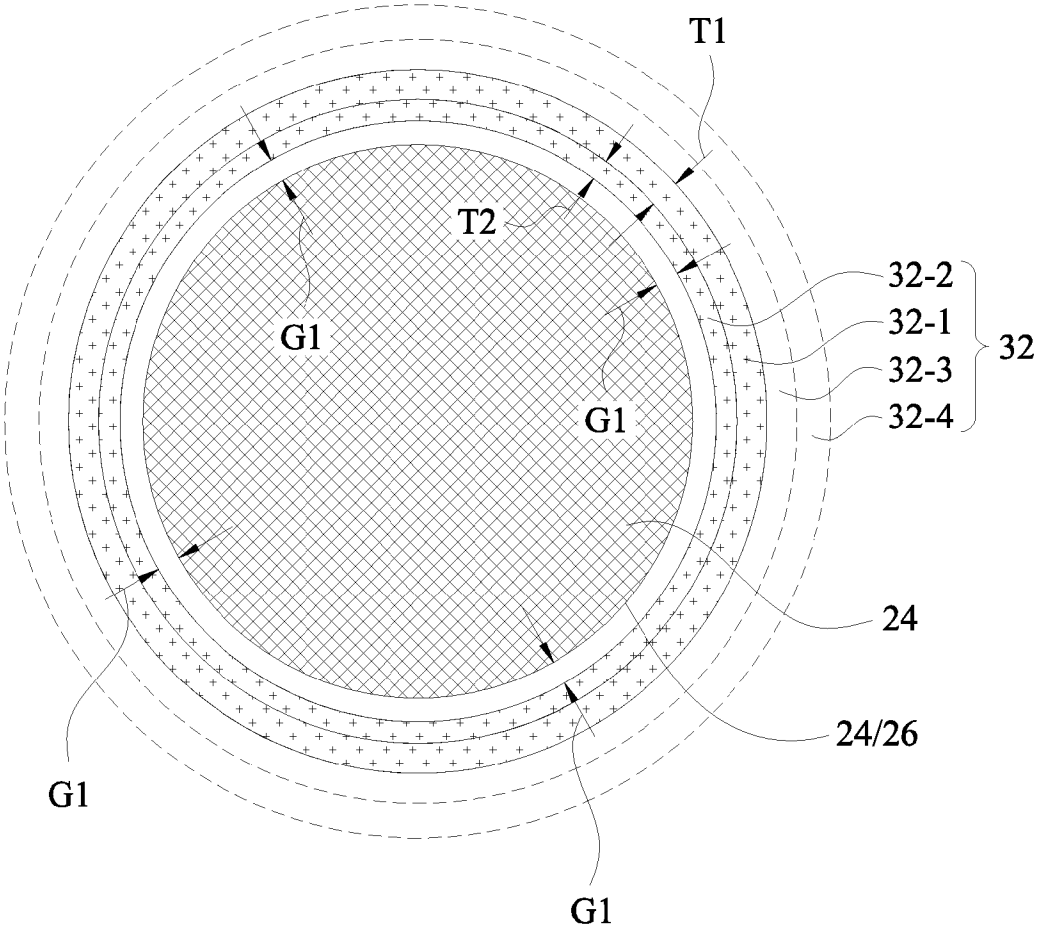
FIG. 6 illustrates a top view of a retaining ring and a membrane in accordance with some embodiments.

FIG. 5 illustrates an exemplary retaining ring 32 in accordance with some embodiments of the present disclosure. Retaining ring 32 includes outer ring 32-1 and inner ring 32-2. Each of outer ring 32-1 and inner ring 32-2 forms a full ring, which may have a uniform thickness measured in the radius direction of retaining ring 32, and measured at the bottoms of rings 32-1 and 32-2. For example, FIG. 6 illustrates a bottom view of retaining ring 32, wherein outer ring 32-1 encircles inner ring 32-2. The outer ring 32-1 and inner ring 32-2 are joined together to form the integrated retaining ring 32. Each of thickness T1 of outer ring 32-1 and thickness T2 of inner ring 32-2 may be in the range between about ⅓ and about ⅔ of the total thickness (T1+T2), so that outer ring 32-1 has enough thickness for it to press on polishing pad 14, and inner ring 32-2 has enough thickness to press polishing pad 14 while at the same time yield to the force from polishing pad 14 as needed.

Referring back to FIG. 4, before retaining ring 32 is pressed on polishing pad 14, the bottom surface of inner ring 32-2 is coplanar with the bottom surface of outer ring 32-1. In accordance with some exemplary embodiments, both inner ring 32-2 and outer ring 32-1 are formed of wear-resistant materials, which may be plastic, ceramic, polymer, etc. For example, each of inner ring 32-2 and outer ring 32-1 may be formed of polyurethane, polyester, polyether, polycarbonate, or combination thereof. In accordance some with exemplary embodiments, inner ring 32-2 and/or outer ring 32-1 is formed of polyphenylene sulfide (PPS), polyetheretherketone (PEEK), or the mix of these materials and other materials such as polymers (for example, polyurethane, polyester, polyether, or polycarbonate). The compositions of inner ring 32-2 and outer ring 32-1 are different from each other. In accordance with some embodiments, the materials of inner ring 32-2 and outer ring 32-1 are the same as each other, but with different percentages (and hence their materials are still different from each other). In accordance with other embodiments, inner ring 32-2 and outer ring 32-1 are formed of different materials, with at least one material presented in either inner ring 32-2 or outer ring 32-1 not presented in the other.

In accordance with some embodiments of the present disclosure, inner ring 32-2 is formed of a material that is softer than the material of outer ring 32-1. Alternatively stated, the hardness of inner ring 32-2 is lower than the hardness of outer ring 32-1. Accordingly, as shown in FIG. 5, the bottom surface of inner ring 32-2 is higher than the bottom surface of outer ring 32-1 by height difference ΔH. In accordance with some embodiments, height difference ΔH is greater than about 0.01 mm, and may be in the range between about 0.01 mm and about 3 mm. It is appreciated that height difference ΔH depends on the retaining ring down force during the CMP process, and greater force results in greater height difference ΔH. The hardness of materials may be measured and represented using various ways including, and not limited to, Shore (durometer) hardness test and Rockwell Hardness test. The hardness of materials may also be represented using Young's modulus.

Figure 7B:
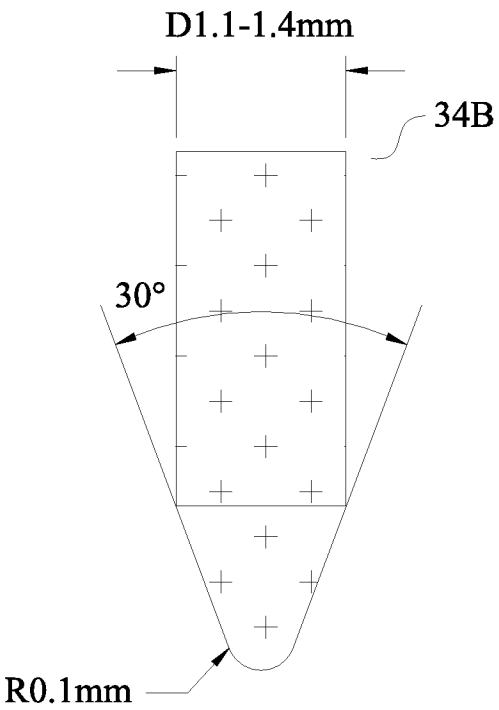
FIGS. 7A and 7B and 8 illustrate indenters and a method, respectively, for determining hardness of a material in accordance with some embodiments.
Figure 7A:
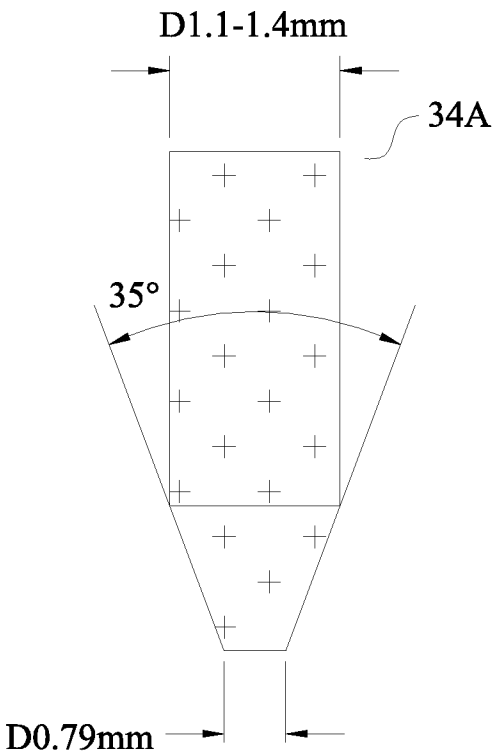

For example, FIGS. 7A and 7B illustrate the indenters for testing the hardness of a material in the Shore test, wherein the indenters are commonly used for testing the hardness of polymers, rubbers, plastics, and/or the like. In Shore hardness test, the hardness of a material is measured by measuring the resistance of the material to the pressing of a spring-loaded needle-like indenter. FIG. 7A illustrates commonly used indenter 34A, and FIG. 7B illustrates commonly used indenter 34B. The shape and the dimensions are schematically illustrated in FIGS. 7A and 7B. Using the indenter 34A as shown in FIG. 7A or indenter 34B as shown in 7B, the hardness of a material can be measured. The hardness measured using indenter 34A in FIG. 7A is referred to as Shore A hardness (scale), and the hardness measured using indenter 34B in FIG. 7B is referred to as Shore D hardness (scale).

Shore A scale is used for testing soft elastomers (rubbers) and other soft polymers. The hardness of hard elastomers and most other polymer materials are measured by Shore D scale. Shore hardness is tested with an instrument called durometer, which utilizes an indenter (such as 34A or 34B) loaded by a calibrated spring (not shown). The hardness is determined by the penetration depth of the indenter under the load. The loading force of Shore D test is 10 pounds (4,536 grams), and the loading force of Shore A test is 1.812 pounds (822 grams). Shore hardness values may vary in the range from 0 to 100. The maximum penetration for each of Shore A and Shore D is 0.097 to 0.1 inch (2.5 mm to 2.54 mm), which correspond to the minimum shore hardness of 0. The maximum hardness value 100 corresponds to zero penetration.

Figure 8:
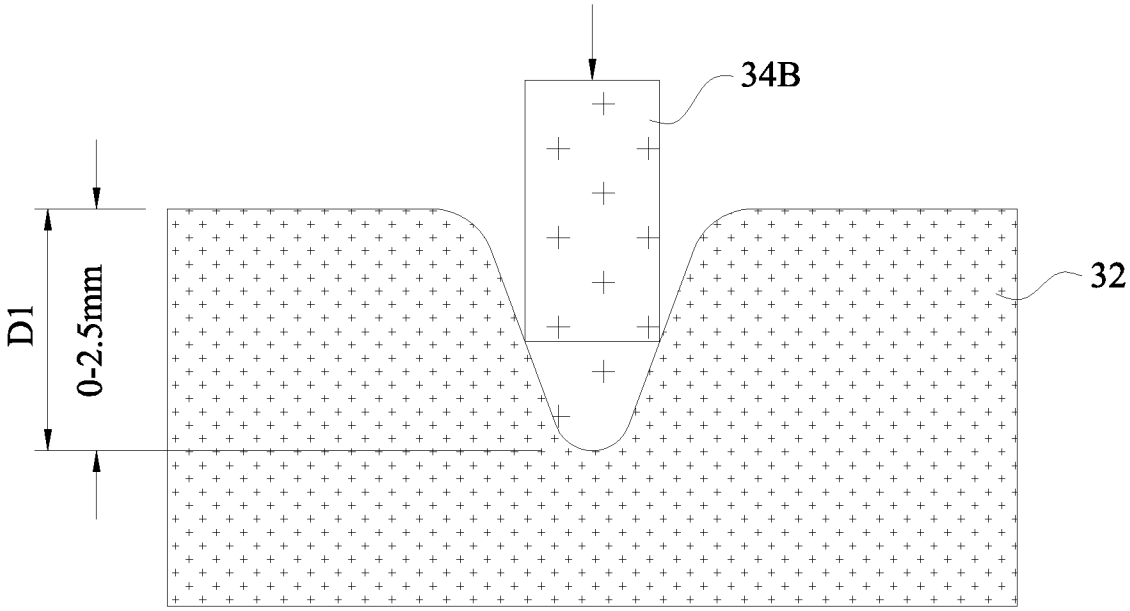

FIG. 8 illustrates the measurement of Shore D hardness of material 32, wherein penetration depth D1 reflects the Shore D hardness value. It is realized when indenter 34B is replaced with the indenter 34A as shown in FIG. 7A, Shore A hardness may be obtained. Shore A hardness and shore D hardness may be converted to each other using Table 1.

TABLE 1

| | | | | | | | | | | | | | | | |
|---|---|---|---|---|---|---|---|---|---|---|---|---|---|---|---|
| Short A | 30 | 35 | 40 | 45 | 50 | 55 | 60 | 65 | 70 | 75 | 80 | 85 | 90 | 95 | 100 |
| Shore D | 6 | 7 | 8 | 10 | 12 | 14 | 16 | 19 | 22 | 25 | 29 | 33 | 39 | 46 | 58 |

Referring back to FIG. 5, in accordance with some exemplary embodiments of the present disclosure, outer ring 32-1 has Shore D hardness in the range between about 80 and about 90, and inner ring 32-2 has Shore D hardness in the range between about 15 and about 65. In accordance with some embodiments, the Shore D hardness value of outer ring 32-1 may be greater than the Shore D hardness value of inner ring 32-2 by about 30 or more.

Referring to FIG. 4, before retaining ring 32 is pressed against polishing pad 14, the bottom surfaces of outer ring 32-1 and inner ring 32-2 are coplanar with each other. After retaining ring 32 is pressed against polishing pad 14, as shown in FIG. 5, inner ring 32-2, due to its lower hardness, yields more to the pressure from polishing pad 14 than outer ring 32-1, resulting in a smaller force applied to the portions of polishing pad 14 directly under inner ring 32-2. Alternatively stated, the deformation of polishing pad 14 becomes smaller. This advantageously improves the uniformity in the removal rate of wafer 24 during the CMP, wherein the removal rate is calculated as the removed thickness per unit time.

The mechanism of the improvement in the removal rate uniformity is explained referring to FIG. 5. Retaining ring 32 pushes polishing pad 14, causing the adjacent part of polishing pad 14 to deform. The part 14A of polishing pad 14 immediately next to the inner edge of retaining ring 32 may protrude, and the part of polishing pad 14 next to the protruding part 14A may recess. This causes the force applied by the portions of polishing pad 14 underlying wafer 24 to vary, and hence the removal rate uniformity of wafer 24 is adversely affected. For example, as shown in FIG. 5, void 35 is illustrated to represent that these edge portions of wafer 24 may receive reduced forces (and sometimes actual voids occur) from polishing pad 14 than the inner portions of wafer 24, and the removal rate of the edge portions of wafer 24 is at least reduced compared to the inner portions, wherein the removal rate of the edge portions may be reduced to zero in some cases due to voids under wafer 24. In the embodiments of the present disclosure, with the inner ring 32-2 being softer, the deformation of polishing pad 14 is less severe, and hence the non-uniformity in the removal rate is reduced.

In accordance with some embodiments of the present application, the multi-layer retaining ring 32 may include three, four, or more (sub) rings formed of different materials, with the outer (sub) rings encircling the inner (sub) rings. From the outer rings to the inner rings, the hardness values are increasingly smaller to maximize the benefit of reducing the non-uniformity in the removal rate. For example, FIG. 6 illustrates that there may be more rings 32-3 and 32-4, which are illustrated using dashed lines to represent these rings may or may not exist. Similar to the embodiments as shown in FIG. 4, the bottom surfaces of rings 32-1, 32-2, 32-3, and 32-4 may be coplanar with each other when retaining ring 32 is not pressed against polishing pad 14. When retaining ring 32 is pressed against polishing pad 14, the bottom surfaces of rings 32-1, 32-2, 32-3, and 32-4 are non-coplanar, with the inner rings having bottom surfaces increasingly higher than the bottom surfaces of the respective outer rings. Furthermore, depending on the total number of sub rings, the difference in shore D values of neighboring sub rings may be greater than 5, greater than 10, or greater than 15 or 30 in various embodiments. In yet alternative embodiments, retaining ring 32 has a gradually and continuously reduced hardness from outer edge to the inner edge, with the hardness difference between the outmost material and the inner most material being greater than about 30 on Shore D scale, for example. The material of retaining ring 32 also has gradually and continuously changed compositions in order to have the changed hardness.

Figure 14:
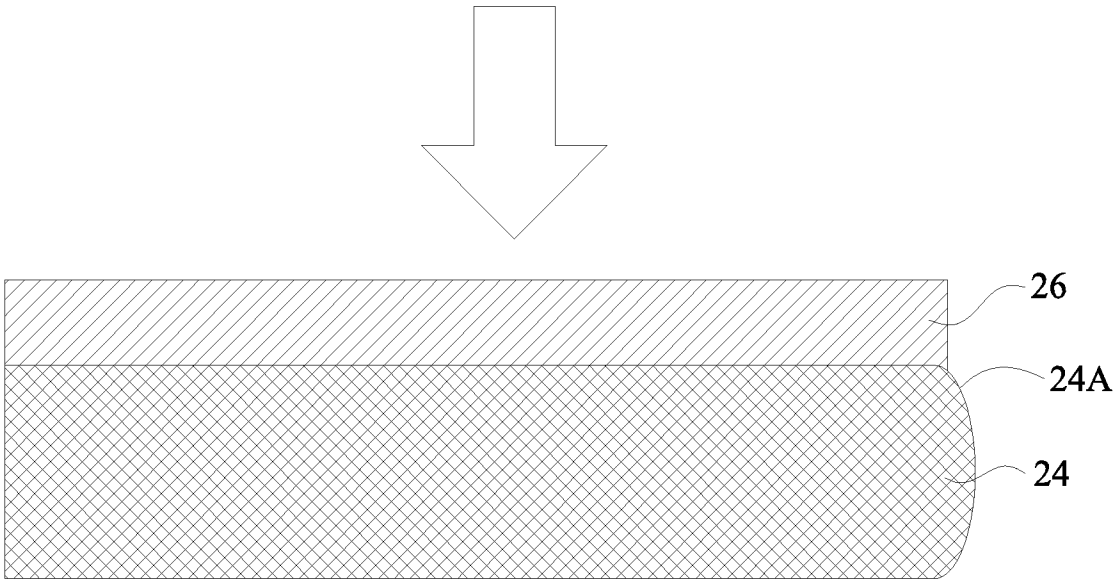
FIG. 14 illustrates a magnified view of a portion of a wafer and a membrane in accordance with some embodiments.

Referring again to FIG. 5, membrane 26 extends to edge 24A of wafer 24, and applies pressing force to the very edge portion of wafer 24. Accordingly, an entire top surface of wafer 24 receives the pressing force from membrane 26. In addition, the force applied to the center of wafer 24 may be equal to, or substantially equal, the force applied to the very edge portion of wafer 24. For example, the force applied to the edge of wafer 24 may be in the range between about 90 percent and about 110 percent (or between about 95 percent and about 105 percent) the force applied to the center of wafer 24. Some wafers may be curved at edges, wherein the curved edges connect the planar top surface to the planar bottom surface. In these embodiments, flexible membrane at least contacts up to the interface between the planar top surface and the curved edges, and may also contact and apply force to some of the curved edges, as illustrated in FIG. 14.

Figure 9:
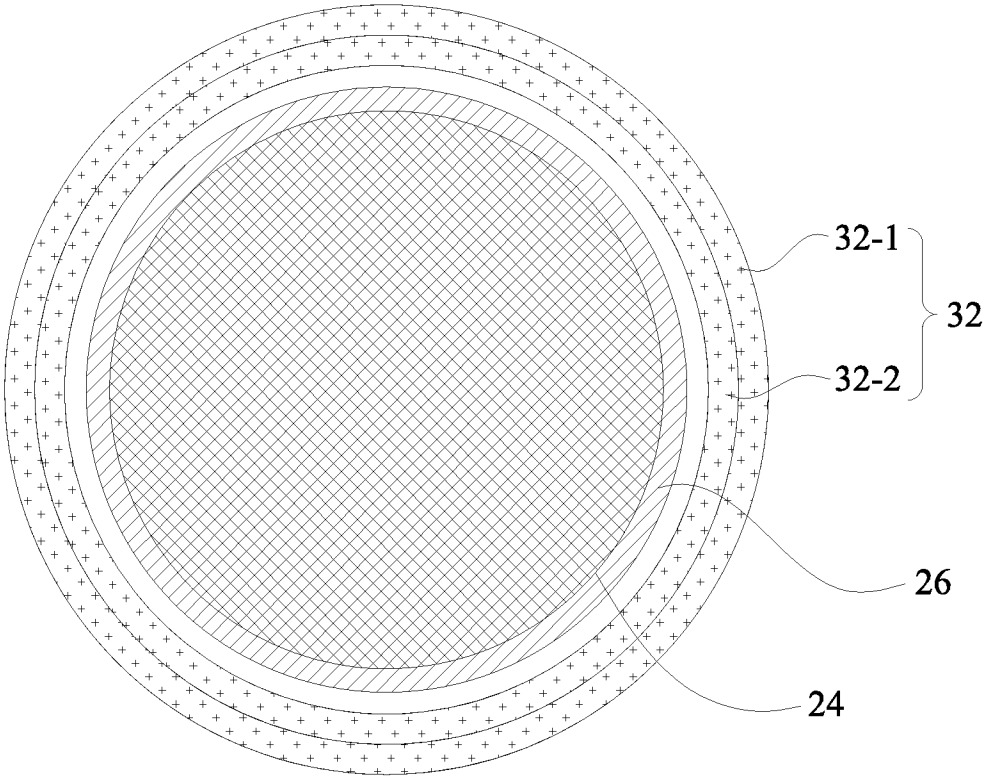
FIG. 9 illustrates a top view of a retaining ring and a membrane in accordance with some embodiments.

Referring again to FIG. 6, which illustrates the bottom view of wafer 24 and membrane 26, membrane 26 extends to the edge of wafer 24, and hence membrane 26 is shown as overlapping wafer 24. FIG. 9 illustrates the bottom view of wafer 24 and membrane 26 in accordance with other embodiments, wherein membrane 26 extends beyond the edges of wafer 24 slightly, so that a margin is left to ensure the entire top surface of wafer 24 (FIG. 5) receives the pressing force from membrane 26.

Figure 10:
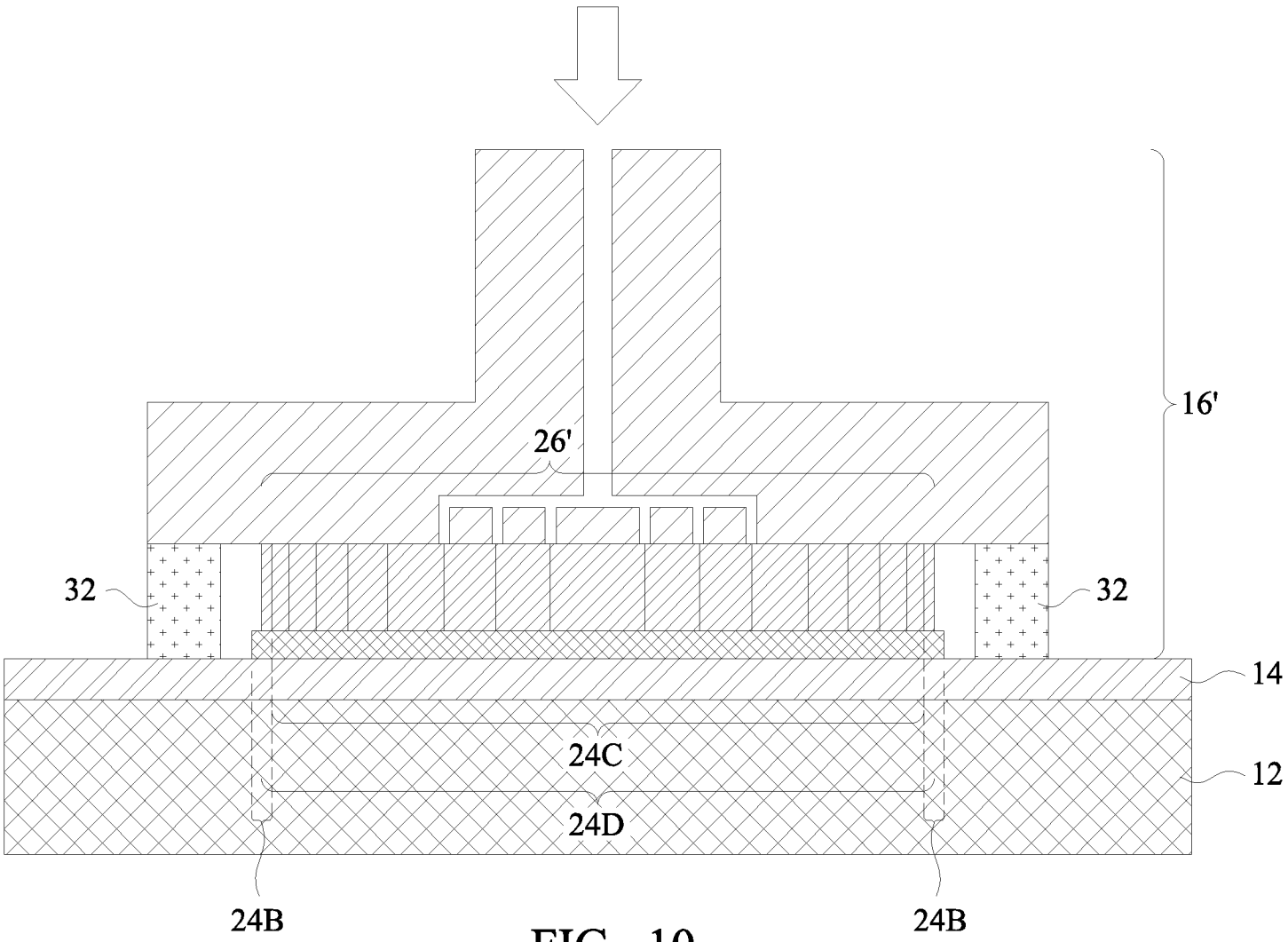
FIG. 10 illustrates the cross-sectional view of a conventional CMP process.

FIG. 10 illustrates polishing head 16 and wafer 24 in a conventional setting. As shown in FIG. 10, wafer 24 includes wafer-edge region 24B and inner region 24C. The wafer-edge region 24B forms a ring encircling inner region 24C. The complete dies are sawed from the inner region 24C, but not from wafer-edge region 24B. Accordingly, in the conventional setting, membrane 26' was in contact with the top surface of inner region 24C but not the entirety of the top surface of the wafer-edge region 24B. Accordingly, in the conventional setting, portion 24D of wafer 24 is pressed by membrane 26'.

Figure 11A:
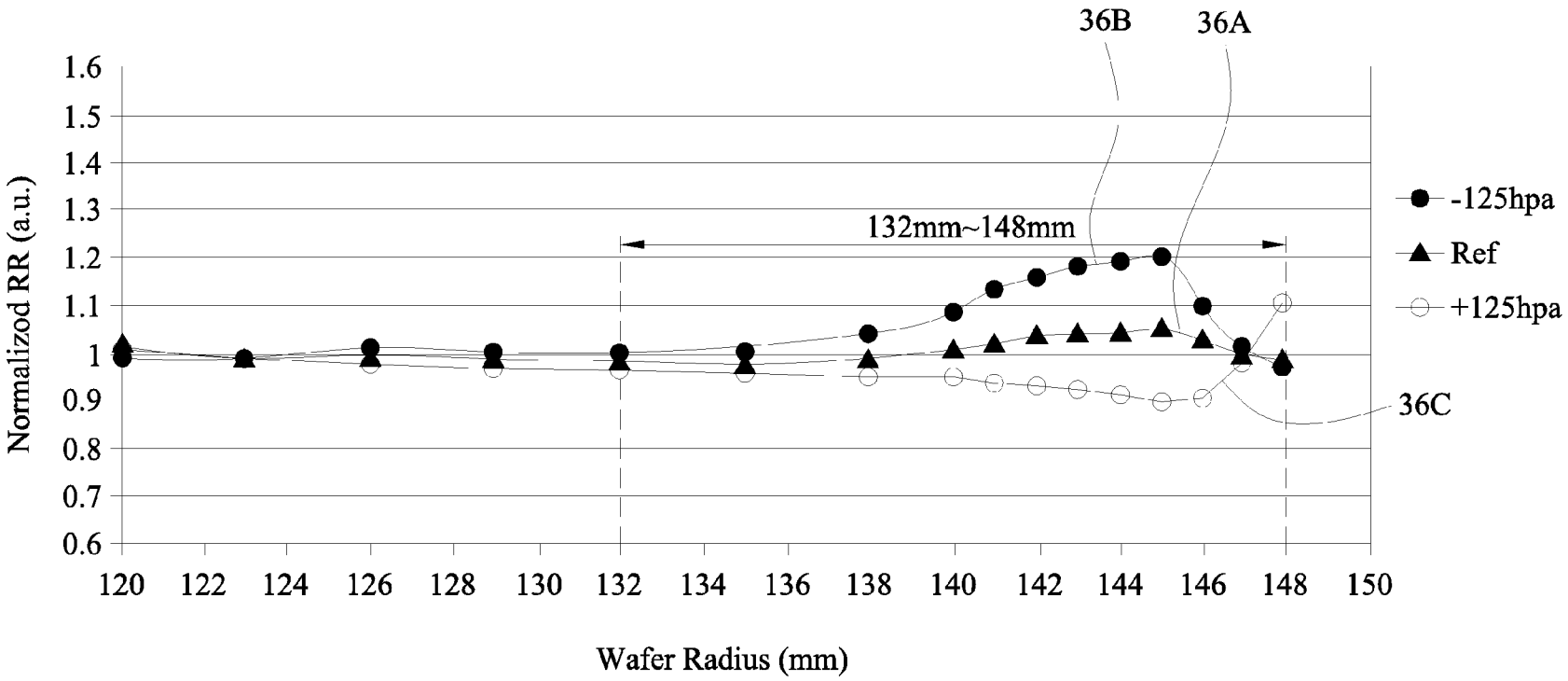
FIGS. 11A and 11B illustrate the normalized removal rate non-uniformity as a function of the locations on a wafer, wherein the effect of increasing the inner diameter of a retaining ring is illustrated.
Figure 11B:
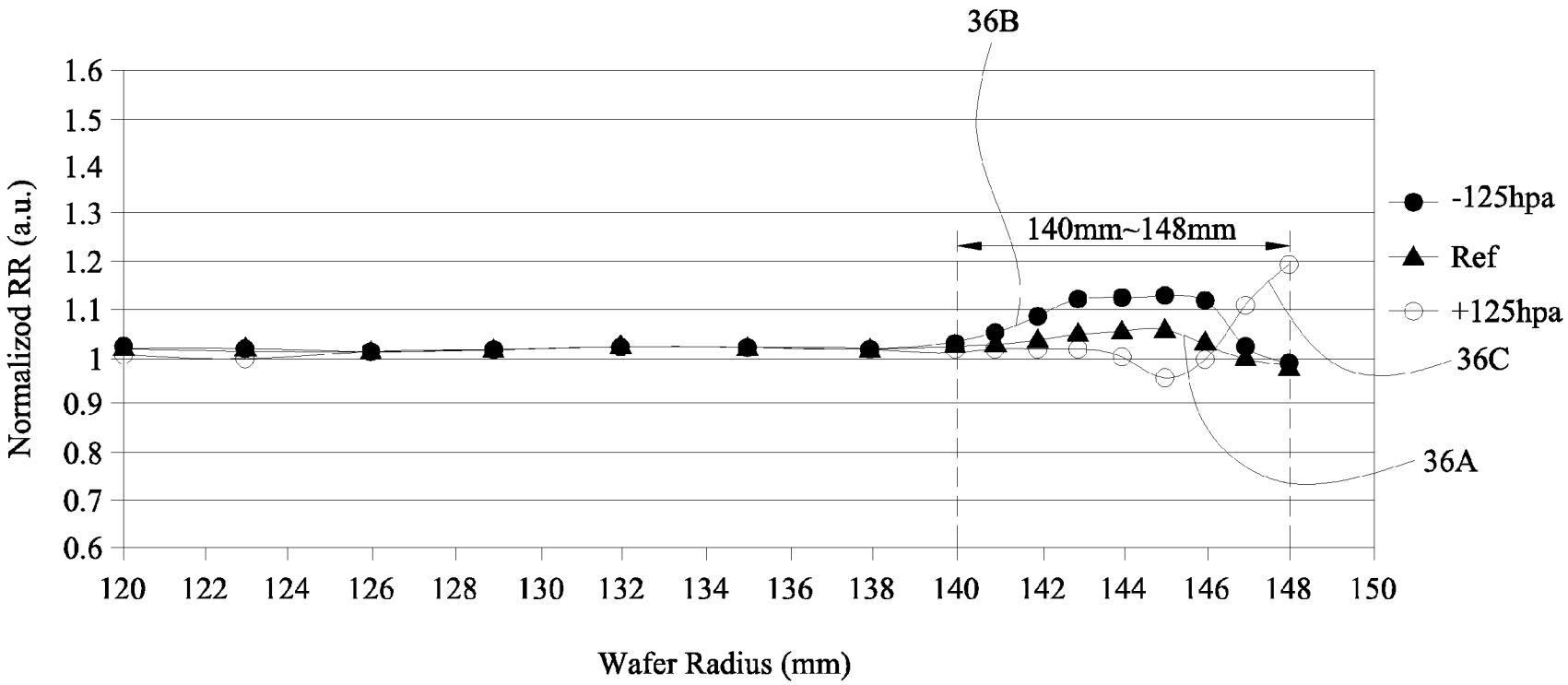
Figure 13:
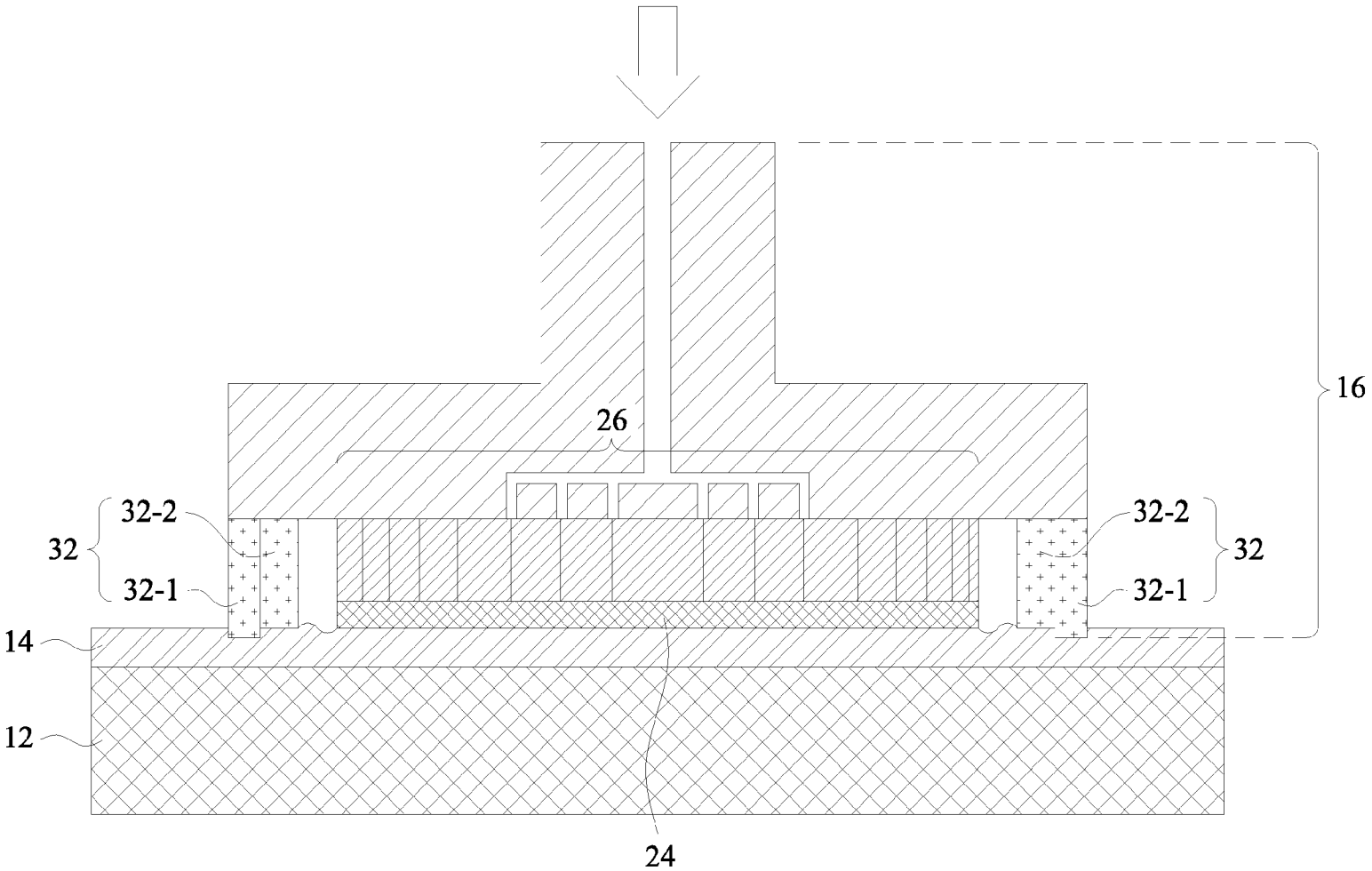
FIG. 13 illustrates the CMP of a wafer in accordance with some embodiments, wherein the inner diameter of a retaining ring and an outer diameter of a membrane are both increased.

In accordance with some embodiments, the inner diameter of retaining ring 32 may also be increased to improve the removal rate uniformity. The increase in the inner diameter of retaining ring 32 is achieved by increasing gap G1 (FIG. 5). In accordance with some embodiments of the present invention, for a 300 mm wafer, gap G1 as shown in FIG. 5 may be increased from 0.5 mm to greater than about 1 mm, or greater than about 1.5 mm. This causes significant improvement in the uniformity. As a result, as shown in FIG. 13, the deformation region of polishing pad (caused by the pressing of retaining ring 32) is shifted away from wafer 24 (as compared to FIG. 5), resulting in an improved removal rate uniformity. FIGS. 11A and 11B illustrate the results obtained from silicon wafer samples, and the results demonstrate the effect of increasing gap G1 (and hence the increasing in inner diameter of retaining ring 32). FIG. 11A illustrates the results corresponding to gap G1 of 0.5 mm, and FIG. 11B illustrates the results corresponding to gap G1 of 1.5 mm.

In each of FIGS. 11A and 11B, the X-axis illustrates the wafer radius, which represents the distance of points on a sample wafer to the center of the wafer having a diameter of 300 mm. Accordingly, distance of 150 mm represents the wafer edge, and distance of 138 mm represents the edge of inner region 24C (FIG. 10), from which the complete dies are obtained. The Y-axis represents the normalized removal rate. Line 36A is obtained by applying a reference pressure to polishing pad 14 through retaining ring 32 so that the removal rates in the inner region (24C in FIG. 10) of the sample wafer are substantially uniform. Line 36B is obtained by increasing the pressure of retaining ring by 125 hectopascals (hpa) relative to the reference pressure. As shown in by line 36B, by increasing the pressure of the retaining ring, the removal rate of the edge portions of the sample wafer is increased. Line 36C is obtained by reducing the pressure of retaining ring by 125 hpa relative to the reference pressure. As shown in by line 36C, by reducing the pressure of the retaining ring, the removal rate of the edge portions of the sample wafer is reduced. Furthermore, lines 36B and 36C illustrate that the non-uniformity of the removal rates is affected by the pressure applied by the retaining ring. In FIG. 11A, the non-uniform region spans from about 132 mm (from wafer center) to about 148 mm. The normalized removal rate ranges from about 0.9 (line 36C) to about 1.2 (line 36B). The region of wafer ranging from 148 mm to 150 mm is not measured since this region of wafer does not generate complete dies.

FIG. 11B illustrates similar results compared to FIG. 11A, except that gap G1 (FIG. 5) is increased to 1.5 mm, while other test conditions remain the same as in FIG. 11A. It is observed that by increasing gap G1 (and also increasing the inner diameter of retaining ring), the non-uniformity in the removal rate becomes less severe. For example, the normalized removal rate is reduced to a range from about 0.95 (line 36C) to about 1.1 (line 36B). In addition, the non-uniform region of the sample wafer is now reduced to a range between about 140 mm and about 148 mm.

Figure 12A:
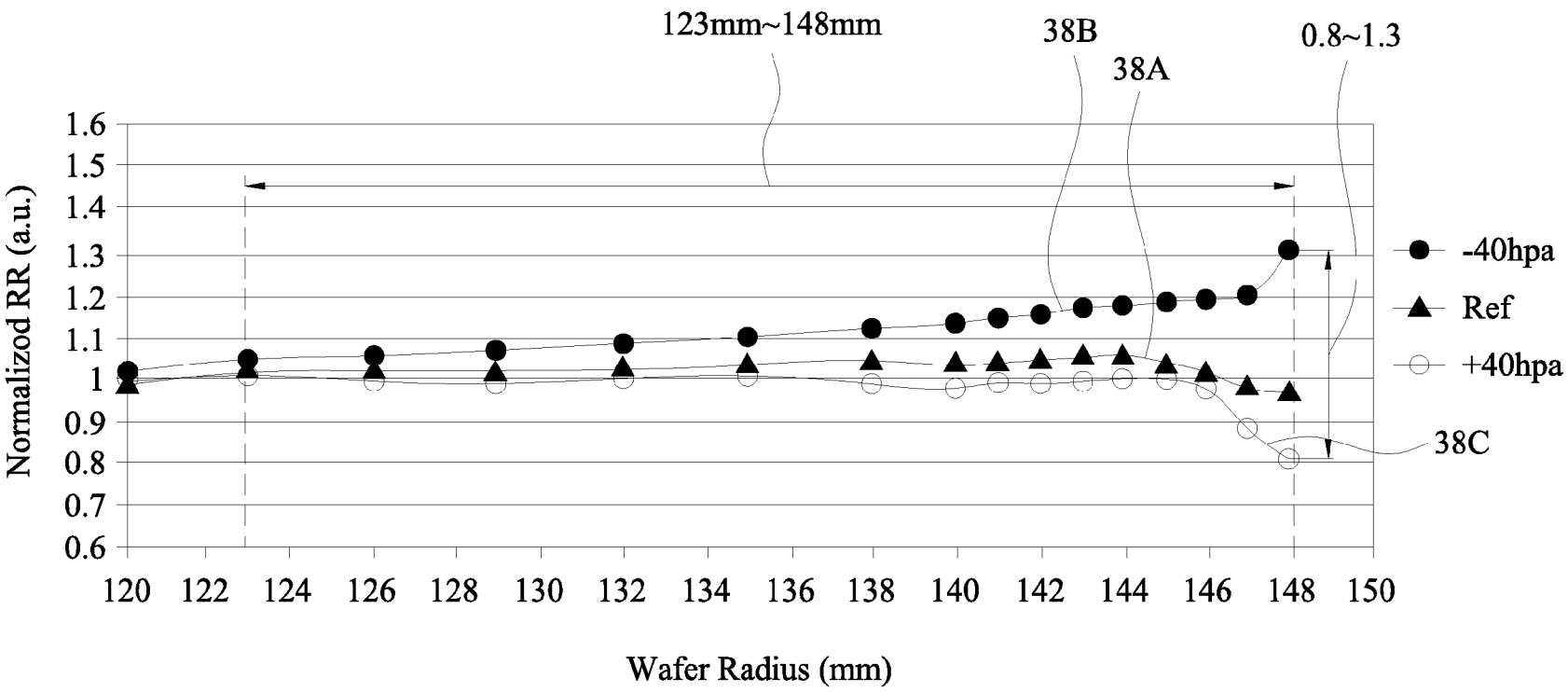
FIGS. 12A and 12 illustrate the normalized removal rate non-uniformity as a function of the locations on a wafer, wherein the effect of increasing the inner diameter of a retaining ring and extending a membrane to wafer edge is illustrated.
Figure 12B:
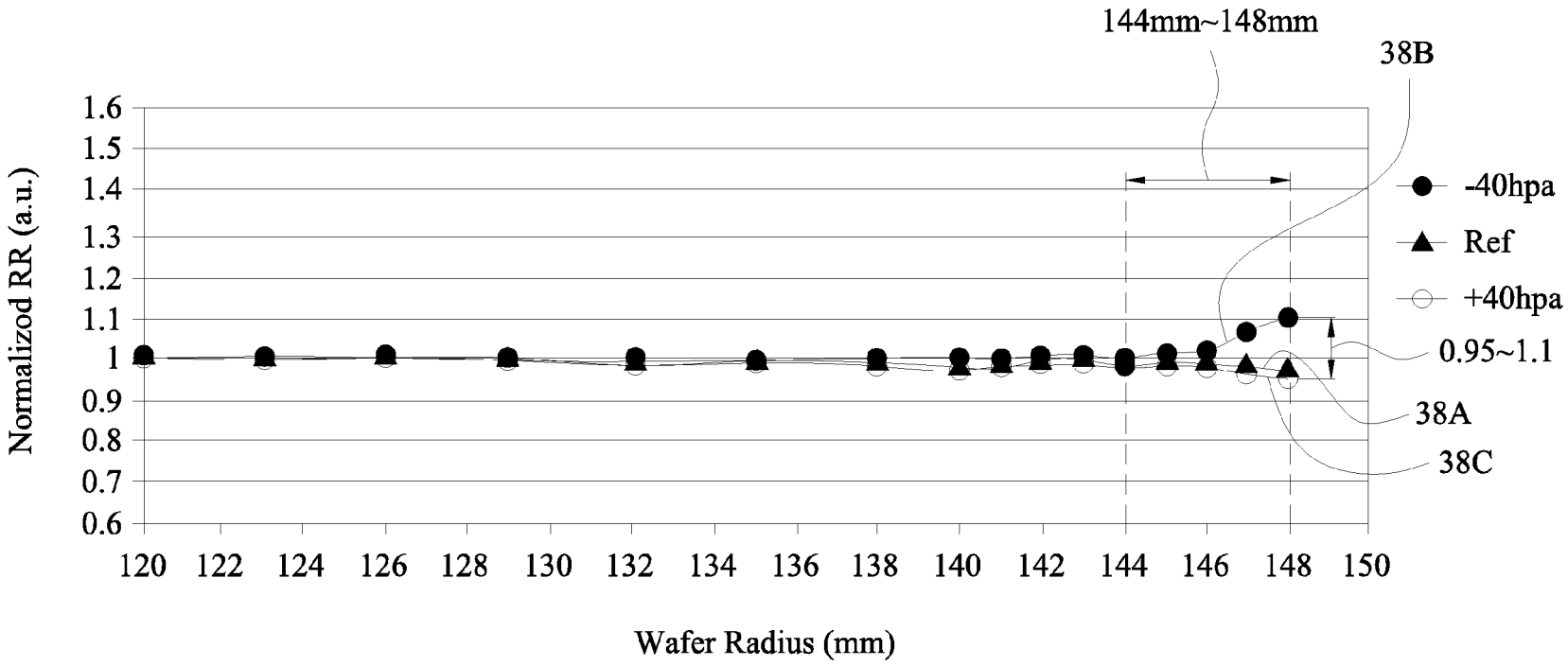

FIGS. 12A and 12B further illustrate the results obtained from silicon wafer samples, and the results demonstrate the effect of increasing the inner edge of retaining ring and extending membrane to contact the entire wafer top surface. The X-axis again represents the distance to the wafer center, and the Y-axis represents the normalized removal rate. Again, lines 38A in FIGS. 12A and 12B are obtained by applying a reference pressure to polishing pad 14 through retaining ring 32 so that the removal rates in the inner region of the sample wafer are substantially uniform.

FIG. 12A illustrates the results obtained when gap G1 (FIG. 5) is 0.5 mm, and membrane 26 extends to 149 mm, which is 1 mm away from the wafer edge. Line 38B is obtained by increasing the pressure of retaining ring by 40 hpa relative to the reference pressure. Line 38C is obtained by reducing the pressure of retaining ring by 40 hpa relative to the reference pressure. As illustrated, lines 38B and 38C in FIG. 12A have the non-uniform region spanning from about 123 mm (to wafer center) to about 148 mm. The largest variation of the normalized removal rate ranges from about 0.8 (line 38C) to about 1.3 (line 38B).

FIG. 12B illustrates similar results compared to FIG. 12A, except that gap G1 (FIG. 5) is increased to 1.5 mm, and membrane extends to contact all the way to the wafer edge, while other test conditions remain the same as in FIG. 12A. It is observed that the non-uniformity in FIG. 12B is less severe compare to FIG. 12A. For example, the highest span of the normalized uniformity ranges from about 0.95 (line 38C) to about 1.1 (line 38B). In addition, the non-uniform region now ranges from about 144 mm to about 148 mm. which is even smaller than the range of 140 mm to 148 mm in FIG. 11B. Accordingly, FIGS. 12A and 12B reveal that increasing gap G1 and expanding membrane to the wafer edge have a beneficial result to the uniformity in the removal rate.

The comparison of FIGS. 11A, 11B, 12A, and 12B reveals that expanding membrane to the wafer edge has beneficial results. This is against the conventional thinking that pressing the inner region 24C (FIG. 10) of wafer 24, but not all the way to the edges of wafer 24, would be enough since the outer region 24B has no complete dies. However, the above-discussed results indicate that extending membrane to the entire wafer 24 has a significant beneficial effect on the whole wafer uniformity of the removal rate.

The embodiments of the present disclosure have some advantageous features. By forming multi-layer retaining ring having different hardness values, expanding membrane to the wafer edge, and/or increasing the inner diameter of the retaining ring, the uniformity of the removal rate of wafer is improved. In accordance with some embodiments of the present disclosure, these methods may be combined in any combination to further improve the uniformity of the removal rate.

In accordance with some embodiments of the present disclosure, an apparatus for performing chemical mechanical polishing on a wafer includes a polishing head that includes a retaining ring. The polishing head is configured to hold the wafer in the retaining ring. The retaining ring includes a first ring having a first hardness, and a second ring encircled by the first ring. The second ring has a second hardness smaller than the first hardness.

In accordance with alternative embodiments of the present disclosure, an apparatus for polishing a wafer includes a polishing head, which has a flexible membrane configured to be inflated and deflated. The flexible membrane is configured to press regions from a center to an edge of a planar top surface of the wafer when inflated.

In accordance with alternative embodiments of the present disclosure, an apparatus for polishing a wafer includes a polishing head, which includes a retaining ring. The polishing head is configured to hold the wafer in the retaining ring. The retaining ring includes a first ring having a first hardness, and a second ring encircled by the first ring. The second ring has a second hardness smaller than the first hardness. A flexible membrane is encircled by the retaining ring. The flexible membrane is configured to be inflated and deflated, and the flexible membrane is configured to press on a curved edge of the wafer when inflated.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An apparatus for polishing a wafer, the apparatus comprising:

a polishing head comprising a retaining ring, wherein the polishing head is configured to hold the wafer in the retaining ring, and the retaining ring comprises:

a first ring having a first hardness on a Shore D scale; and a second ring encircled by the first ring, wherein the second ring has a second hardness on the Shore D scale smaller than the first hardness by a difference greater than about 30 on the Shore D scale, and wherein the polishing head is configured to hold the wafer in the retaining ring such that an innermost sidewall of the second ring is separated from the wafer by a gap.

2. The apparatus of claim 1, wherein the retaining ring further comprises a third ring encircled by the second ring, wherein the third ring has a third hardness smaller than the second hardness, and a bottom surface of the third ring is substantially coplanar with a bottom surface of the second ring and a bottom surface of the first ring.

3. The apparatus of claim 1, wherein a bottom surface of the first ring and a bottom surface of the second ring are substantially coplanar with each other.

4. The apparatus of claim 1 further comprising a flexible membrane configured to press on the wafer, wherein the flexible membrane is configured to press on an entire top surface of the wafer when inflated.

5. The apparatus of claim 4, wherein the flexible membrane has a diameter greater than a diameter of the wafer.

6. The apparatus of claim 1, wherein each of the first ring and the second ring has a uniform thickness.

7. The apparatus of claim 1, wherein each of the first ring and the second ring has a thickness in a range between about one third and about two thirds of a total thickness of the first ring and the second ring.

8. The apparatus of claim 1, wherein the polishing head is configured to drive the wafer to rotate along a first axis, and the apparatus further comprises:

a polishing pad configured to rotate along a second axis; and a slurry dispenser having an outlet over the polishing pad.

9. The apparatus of claim 1, wherein the retaining ring has an inner diameter greater than a diameter of the wafer by greater than about 2 mm.

10. An apparatus for polishing a wafer, the apparatus comprising:

a polishing head comprising:

a flexible membrane configured to be inflated and deflated, wherein the flexible membrane is configured to press an entirety of the wafer when inflated; and a retaining ring comprising:

a first ring having a first hardness; and a second ring having a second hardness, wherein the second hardness is less than the first hardness by a difference greater than about 30 on Shore D scale, and wherein the second ring is configured to yield more than the first ring when a force is applied to the first ring and said force is applied to the second ring.

11. The apparatus of claim 10, wherein the flexible membrane is configured to apply a first force to a center of the wafer, and simultaneously apply a second force to an interface between a planar top surface and a curved top surface of an edge portion of the wafer, wherein the first force is substantially equal to the second force.

12. The apparatus of claim 11, wherein the flexible membrane is further configured to apply a force to the edge portion of the wafer.

13. The apparatus of claim 10, wherein the flexible membrane comprises a plurality of zones configured to be inflated to different pressures.

14. The apparatus of claim 10, wherein the flexible membrane extends beyond edges of the wafer.

15. The apparatus of claim 10, wherein before said force is applied to the second ring, a bottom surface of the first ring and a bottom surface of the second ring are substantially coplanar with each other.

16. The apparatus of claim 15, wherein each of the first ring and the second ring has a thickness in a range between about one third and two thirds of a total thickness of the first ring and the second ring.

17. An apparatus for polishing a wafer, the apparatus comprising:

a polishing head comprising:

a retaining ring, wherein the polishing head is configured to hold the wafer in the retaining ring, and the retaining ring comprises:

a first ring, wherein the first ring has a first hardness; and a second ring encircled by the first ring, wherein the second ring has a second hardness smaller than the first hardness by a difference greater than about 30 on Shore D scale, and wherein the second ring is configured to apply a smaller force to a polishing pad than the first ring when a first force is applied to the first ring and said first force is applied to the second ring; and a flexible membrane encircled by the retaining ring, wherein the flexible membrane is configured to be inflated and deflated, and the flexible membrane is configured to press on a curved edge of the wafer when inflated.

18. The apparatus of claim 17, wherein the wafer comprises a planar top surface and the curved edge connected to the planar top surface, and wherein the flexible membrane is configured to apply a first force to a center of the wafer, and a second force to an interface between the planar top surface and the curved edge, with the second force substantially equal to the first force.

19. The apparatus of claim 17, wherein a bottom surface of the first ring and a bottom surface of the second ring are substantially coplanar with each other.

20. The apparatus of claim 17, wherein a bottommost surface of the flexible membrane is below a topmost surface of the wafer when the flexible membrane is inflated.

* * * * *